US008340335B1

(12) United States Patent
Shennib

(10) Patent No.: US 8,340,335 B1
(45) Date of Patent: Dec. 25, 2012

(54) HEARING DEVICE WITH SEMIPERMANENT CANAL RECEIVER MODULE

(75) Inventor: Adnan Shennib, Oakland, CA (US)

(73) Assignee: iHear Medical, Inc., Oakland, CA (US)

( * ) Notice: Subject to any disclaimer, the term of this patent is extended or adjusted under 35 U.S.C. 154(b) by 250 days.

(21) Appl. No.: 12/855,646

(22) Filed: Aug. 12, 2010

Related U.S. Application Data

(60) Provisional application No. 61/272,114, filed on Aug. 18, 2009.

(51) Int. Cl.
*H04R 25/02* (2006.01)
*H04R 25/00* (2006.01)

(52) U.S. Cl. ..... 381/328; 381/315; 381/323

(58) Field of Classification Search ..... 381/328, 381/329, 314, 315, 322, 323, 324, 331, 380, 381/23.1
See application file for complete search history.

(56) References Cited

U.S. PATENT DOCUMENTS

| | | | | |
|---|---|---|---|---|
| 3,659,056 | A * | 4/1972 | Morrison et al. | 381/315 |
| 4,628,907 | A * | 12/1986 | Epley | 600/25 |
| 4,817,607 | A * | 4/1989 | Tatge | 623/10 |
| 5,425,104 | A * | 6/1995 | Shennib | 381/326 |
| 5,603,726 | A * | 2/1997 | Schulman et al. | 607/57 |
| 5,615,229 | A * | 3/1997 | Sharma et al. | 375/259 |
| 5,701,348 | A * | 12/1997 | Shennib et al. | 381/328 |
| 6,137,889 | A | 10/2000 | Shennib et al. | |
| 6,359,993 | B2 * | 3/2002 | Brimhall | 381/328 |
| 6,473,513 | B1 | 10/2002 | Shennib et al. | |
| 6,694,034 | B2 * | 2/2004 | Julstrom et al. | 381/315 |
| 6,724,902 | B1 * | 4/2004 | Shennib et al. | 381/328 |
| 6,940,988 | B1 | 9/2005 | Shennib et al. | |
| 6,940,989 | B1 * | 9/2005 | Shennib et al. | 381/326 |
| 7,113,611 | B2 | 9/2006 | Leedom et al. | |
| 7,164,775 | B2 * | 1/2007 | Meyer et al. | 381/322 |
| 7,181,032 | B2 * | 2/2007 | Jakob et al. | 381/314 |
| 7,215,789 | B2 * | 5/2007 | Shennib et al. | 381/328 |
| 7,227,968 | B2 * | 6/2007 | van Halteren et al. | 381/328 |
| 7,266,208 | B2 * | 9/2007 | Charvin et al. | 381/328 |
| 7,298,857 | B2 | 11/2007 | Shennib et al. | |
| 7,310,426 | B2 | 12/2007 | Shennib et al. | |
| 7,403,629 | B1 | 7/2008 | Aceti et al. | |
| 7,421,087 | B2 * | 9/2008 | Perkins et al. | 381/331 |

(Continued)

OTHER PUBLICATIONS

Wu, et al., "Selective Signal Transmission to Inlaid Microcoils by Inductive Coupling", IEEE Transducers 2003, 12th International Conference of Solid State Sensors Transducers, Boston, 2003.

*Primary Examiner* — Edgardo San Martin
(74) *Attorney, Agent, or Firm* — Dorsey & Whitney LLP

(57) ABSTRACT

A modular canal hearing device having a speaker module placed in the bony region for extended wear while a main module is removably inserted in the cartilaginous region. The main module wirelessly activates the speaker module when placed in proximity thereto. The main module is removed daily or as needed for maintenance of the hearing device such as for battery replacement. The speaker module remains undisturbed in the bony region to avoid skin friction. The main module contains the microphone, electronics, battery and in the preferred embodiment an inductive coupling coil for inductively sending audio signals to the receiver module. The modular design allows for a highly miniaturized design that is easier to navigate in the ear canal for improved fit and sound fidelity at the eardrum while allowing easy maintenance of a removable module.

24 Claims, 6 Drawing Sheets

U.S. PATENT DOCUMENTS

| | | | | |
|---|---|---|---|---|
| 7,424,124 | B2 | 9/2008 | Shennib et al. | |
| 7,512,383 | B2 * | 3/2009 | Essabar et al. | 455/78 |
| 7,720,242 | B2 * | 5/2010 | Anderson et al. | 381/328 |
| 8,036,405 | B2 * | 10/2011 | Ludvigsen et al. | 381/317 |
| 8,116,494 | B2 * | 2/2012 | Rass | 381/328 |
| 8,175,306 | B2 * | 5/2012 | Meskens et al. | 381/315 |
| 2004/0234092 | A1 * | 11/2004 | Wada et al. | 381/331 |
| 2007/0274553 | A1 * | 11/2007 | Rass | 381/328 |
| 2008/0095387 | A1 * | 4/2008 | Niederdrank et al. | 381/314 |
| 2009/0052706 | A1 * | 2/2009 | Gottschalk et al. | 381/314 |
| 2009/0169039 | A1 * | 7/2009 | Rasmussen et al. | 381/322 |
| 2009/0196444 | A1 * | 8/2009 | Solum | 381/315 |
| 2010/0086157 | A1 * | 4/2010 | Feeley et al. | 381/324 |
| 2010/0254553 | A1 * | 10/2010 | Nikles et al. | 381/314 |
| 2010/0272299 | A1 * | 10/2010 | Van Schuylenbergh et al. | 381/315 |
| 2011/0019847 | A1 * | 1/2011 | Klemenz et al. | 381/315 |
| 2011/0091060 | A1 * | 4/2011 | Von Dombrowski et al. | 381/328 |
| 2011/0182453 | A1 * | 7/2011 | Van Hal et al. | 381/328 |
| 2011/0243357 | A1 * | 10/2011 | Probst et al. | 381/328 |
| 2011/0286616 | A1 * | 11/2011 | Beck et al. | 381/315 |

* cited by examiner

HEARING DEVICE WITH SEMIPERMANENT CANAL RECEIVER MODULE

CROSS-REFERENCE

This application claims the priority benefit of U.S. Provisional Application Ser. Nos. 61/272,114, filed Aug. 18, 2009, which is incorporated herein by reference in its entirety for all purposes.

TECHNICAL FIELD

The present invention relates to hearing devices, and, more particularly, to hearing devices that are inconspicuous and positioned in the ear canal for extended wear.

BACKGROUND OF THE INVENTION

Brief Description of Ear Canal Anatomy and Physiology

The ear canal 10 (FIG. 1) is generally narrow and tortuous and is approximately 26 millimeters (mm) long from the canal aperture 11 to the tympanic membrane 15 (eardrum). The lateral-part 12 is referred to as the cartilaginous region due to the underlying cartilaginous tissue 19. The cartilaginous region 12 of the ear canal 10 deforms in shape and moves in response to the mandibular (jaw) motions, which occur during talking, yawning, eating and also when sleeping over the ear. Hair and earwax (cerumen) are primarily present in this cartilaginous region 12. The medial part, proximal to the tympanic membrane, is rigid and referred to as the bony region 13 due to the underlying bone tissue 7. The skin in the bony region is very thin (relative to the skin in the cartilaginous region) and is far more sensitive to touch or pressure. A characteristic bend roughly occurring at the bony-cartilaginous junction 8 separates the cartilaginous region 12 and the bony region 13. The dimensions and contours of the ear canal vary significantly among individuals.

A cross-sectional view of the typical ear canal (not shown) reveals generally oval shape with a long diameter in the vertical axis and a short diameter in the horizontal axis. Canal dimensions vary significantly along the ear canal and among individuals. FIG. 2 shows an alternate view of the ear canal 10 (top-down) indicting the narrowness of the contoured ear canal. This view shows the challenge of placing a contiguous hearing device entirely in the ear canal, particularly for placement in the bony region 13. Even with smaller receivers fitting in the bony region 13, frequent insertions leads to skin irritation, pain and lacerations. For this reason among others, canal placements have been largely limited to the cartilaginous region. Placement of a device entirely in the bony region is not possible with state of the art components due to component size limitations and to difficulty in accessing a hearing device placed deeply and entirely in the bony region alone. Nevertheless, placement of a speaker in the bony region is desired to achieve acoustic advantages including reduction of occlusion effect, less distortion, less receiver vibrations, improved high frequency reception, and other non-acoustic benefits such as reduced receiver exposure to earwax, water and moisture.

Physiological debris is primarily produced in the cartilaginous region 12 of the ear canal, and includes cerumen (earwax), sweat, and oils produced by the various glands underneath the skin in the cartilaginous region. Debris is naturally extruded from the ear canal by the process of lateral epithelial cell migration which starts from the tympanic membrane laterally towards the lateral (outer) par of the ear canal. There is no cerumen production or hair in the bony part of the ear canal thus less exposure to debris for parts placed in the bony region. The ear canal ends medially (inner direction) at the tympanic membrane 15 is which is connected to the ossicular bone chain and more specifically to the malleus handle 17. Externally and lateral to the ear canal are the concha 5 and the auricle 6 which are important for collecting sound and frequency shaping it into the ear canal.

Several types of hearing losses affect millions of individuals. Hearing loss naturally occurs as we age beginning at higher frequencies (above 4000 Hz) and increasingly spreads to lower frequencies with age.

The Limitations of Conventional Canal Hearing Devices

The limitation of current canal hearing devices is well described in US patent applications U.S. Pat. No. 6,473,513 and U.S. Pat. No. 6,137,889 incorporated herein by reference. These limitations include the well know occlusion effect (speaking into a barrel effect), dexterity limitation for placing a device deep in the ear canal, device size for fitting a miniature device with all standard components including a microphone, circuitry, battery and a receiver (speaker) into ear canals, particularly small and contoured ones. A major limitation is the propensity of a completely-in-the-canal (CIC) device to feedback when set at high volume settings due to the proximity of internal components and the mechanical coupling within the integrated device package. Integrated CIC and in-the-canal (ITC) devices in general, such as in U.S. Pat. No. 5,701,348 are typically not offered to those with severe impairment due to feedback concerns for the high gain requirements.

The Limitation of Current Extended Wear Hearing Devices

Extended wear devices recently conceived and developed are disclosed in U.S. Pat. No. 7,424,124, U.S. Pat. No. 7,310,426, U.S. Pat. No. 7,298,857, U.S. Pat. No. 7,215,789, U.S. Pat. No. 6,940,988 and U.S. Pat. No. 6,473,513. They attempt to circumvent the limitation of conventional canal hearing devices, mainly by placing a device deep in the ear canal in close proximity to the tympanic membrane thus reducing the level of amplification needed to deliver sound to the tympanic membrane. A major limitation of prior art extended wear device is the high contraindication leading o the exclusion of approximately 50% of potential wearers according to industry reports. The high contraindication rate is mostly due to size and shape limitation of the ear. These devices also suffer from limited longevity, rarely reaching 4 months, due to the contamination and damage to the continuously worn device from earwax and moisture accumulation in the ear canal. The long term sealing of the extended wear devices prevents moisture from periodically drying out as would normally occur in the unoccluded ear canal. The cost of prior art extended wear devices is high and prohibitive to most consumers.

In contrast, daily wear canal devices have the advantage of being removed daily to periodically maintain the device such as drying it out, replace the battery when needed and allow the ear canal to rest and dry out. On the other hand, an extended wear canal device has the distinct advantage of deeper canal placement thus "invisible" with reduced stigma. However, as mentioned before, it is not possible to insert an integrated device package in many ears, particularly in small and contoured ear canals. Providing articulation with respect to the receiver portion (for example U.S. Pat. No. 7,424,124) helps in dealing with the insertion but also presents known problems such as jackknifing and lack of visualization during the insertion process. For example, one inserting the device cannot know how deep the receiver portion is in the bony region, since receiver viewing is entirely blocked by the lateral portion of the hearing device.

It is well known that moisture and contamination are mainly present in the cartilaginous part of the ear unlike the boy region, which is relatively "clean". However, the cartilaginous region is far less sensitive to frequent touch and pressure, unlike the bony region which is easily prone to damage and irritation, particularly from frequent device insertions. These paradoxical constrains have prevented the hearing aid industry from providing an "invisible" hearing device that is easy to insert, comfortable to wear, long-lasting, cost effective for the user, and easy to maintain.

It is a principal objective of the present invention to provide a more optimal combination of features including; (1) delivering sound deeper in the bony region within exceptional proximity to the eardrum, (2) provide extended wear in the bony region without resorting to daily insertions and removals therein, (3) provide easy access for device maintenance, and (4) provide moisture relief for the device and the canal.

Another objective is to provide a more space efficient design of a canal device that fits a greater range of ears including small and contoured ones, thus reducing the contraindication rate experienced by current designs.

A further objective of the invention is to provide an acoustically non-occluding hearing device by selectively occluding the bony region while providing occlusion-relieve venting and moisture drying in the ear canal.

The terms "short-term" and "daily wear" are used interchangeably, and so are the terms "semi-permanent" and "extended-wear". "Short-term" and "extended-wear" are relative terms and intended here to contrast one another. Extended-wear refers herein to continuous wear exceeding 1 month, and preferably exceeding 4 months as enabled by the present invention. Short term generally refers to daily wear as known in conventional hearing devices and further defined herein as any wear of less than 1 month. The words "speaker" and "receiver" are used interchangeably throughout the application.

BRIEF SUMMARY OF THE INVENTION

The present invention provides a modular canal hearing device positioned entirely in the ear canal having a receiver module (also referred to as speaker module) that is separate and is inserted in the bony region semi-permanently. A separate main module is subsequently placed laterally in the cartilaginous part of the ear canal and is removable separately from the ear canal for maintenance while the receiver module remains therein for relatively an extended period. The receiver module comprises a receiver (speaker) and a retainer for retaining the speaker module and providing acoustic sealing to prevent feedback. The receiver module also comprises a wireless coupler for wirelessly receiving power and/or audio signals from the main module. The receiver module is passive and activated by wireless near-field coupling when the main module is inserted in the ear canal in proximity thereto.

The placement of the receiver module in the bony region is semi-permanent thus minimizes insertion frictions in the bony region, known to be extremely sensitive to touch and pressure. The receiver module being extremely small and separate from the rest of the device allows for improved fit, manipulation, visualization and navigation into and out of the ear canal. The receiver module is not encumbered by the presence of large components associated with an integrated hearing device. Similarly, the main module is smaller by excluding a receiver assembly, thus easier to insert and manipulate into and out of the ear canal.

The receiver module is placed in proximity to the tympanic membrane resulting in superior sound and energy efficiency. The main module comprises a microphone, a battery, a sound processor/amplifier (electronic circuit), and in the preferred embodiment an inductive coupling coil for transmitting audio signals wirelessly to the receiver module. The receiver module remains immobile during its semi-permanent wear in the ear canal. The immobility of the receiver module allows for rapid acclimation of the sensitive bony region to the receiver module as a foreign object. In contrast, the main module is positioned in the cartilaginous region, which is robust and far less sensitive to frequent touch and motion of the device including from mandibular movements. When the main module is removed, the receiver module remains in the ear canal with its acclimated skin undisturbed.

The main module and the receiver module are electromechanically isolated, either by an air gap or by the incidental contact of the coupling elements. At least one coupling element, if connecting, must be flexibly connected to provide vibration isolation to control feedback. Vibration-caused feedback is well known in hearing aid design and particularly for CICs, thus they are limited in their application to less severe hearing impairments. The present invention eliminates such vibration coupling and also prevents the transfer of motion from the main module to the receiver module (for example due to jaw movements, sleeping on the ear, yawning, etc.), thus eliminating skin rubbing and irritation in the bony region where the receiver module resides.

The main module is placed preferably entirely in the ear canal with the lateral end at or past its aperture, beyond the concha region. In other embodiments, the main module may extend to the concha region for improved access for persons of limited dexterity. The receiver module being in the bony region is less prone to contamination from physiologic debris (i.e, cerumen) present in the cartilaginous area thus can be worn for extended wear exceeding 4 months. By eliminating frequent insertions, cumulative scooping of earwax is minimized. Earwax contamination of receiver sound port is a common problem that plagues canal hearing devices, leading to exceptionally high repair and return rates.

Deep placement of the invented device allows for invisible and hassle-free wear, features highly sought after by hearing impaired individuals. Placement of the microphone inside the ear canal or within the concha area provides natural sound pick-up by taking advantage of natural ear acoustics. The combined effect of receiver placement near the eardrum and microphone placement in the ear leads to significantly improved sound quality including less distortion, less apparent noise, less wind noise, improved frequency response, and improved speech perception by preserving localization of sound, particularly in noisy conditions.

The receiver module is preferably inserted by a hearing professional such as an ENT physician, an audiologist or a hearing specialist to provide proper inspection and cleaning of the ear canal and for the safe placement of the receiver module deep in the bony region within exceptional proximity of the eardrum. The receiver module is preferably placed within 4-10 mm from the eardrum. The main module is designed for self-insertion and self-removal, since it is more accessible and with less concern for damage to the ear canal. The modules comprise compressible retainers, which are preferably generic and assorted in size and shape to fit a variety of ear canals without resorting to custom manufacturing as with conventional canal devices. In the preferred embodiments, the main device is remotely controlled for activation and or adjustment as well known in the field of hearing aid design.

The main module can be removed relatively frequently as needed to maintain the device or the ear canal. For example to replace the battery, replace a disposable cover, replace a sound filter, clean the device, recharge the battery if rechargeable, drying the device, or to simply rest and aerate the ear canal. The receiver module may be designed for self-insertion but preferably after sizing and trial fit by a hearing professional to ensure proper size, fit, and medical considerations of the ear, particularly in the bony region.

In the preferred embodiment, the receiver module remains in the bony region continuously for extended wear exceeding four months while the main module is removed daily or as needed for device and ear canal maintenance.

In one aspect, the present invention provides a modular hearing device for inconspicuous wear in the ear canal, comprising: a speaker module for placement medially in the ear canal in the bony region and in proximity to the eardrum, said speaker module comprises a speaker assembly for delivering amplified sound to the tympanic membrane, a skin contacting retainer concentrically positioned over said speaker assembly for retaining said receiver assembly entirely in said ear canal, and a receive coil for wireless reception of electromagnetic signal representing audio signals; and a main module laterally positioned primarily in the cartilaginous region of the ear canal, comprising a microphone, a power source and a transmit coil for wireless transmission of said electromagnetic signal representing audio signal to said receive coil within said speaker module, said main module is separately removable from the ear canal while said speaker module remains therein when said main module is removed; and wherein said speaker module is activatable by the presence of said main module when placed inside the ear canal in proximity thereto.

In some embodiments, the retainer provides acoustic attenuation of at least 20 decibels between said speaker assembly output and microphone input within the audiometric frequency range between 500 and 4000 Hz. In some embodiments, the power source is a primary battery or a rechargeable battery. In some embodiments, the said receive coil and/or transmit coil comprise a flexible connection for providing vibration and motion isolation between said speaker module and said main module when said receive and transmit coils are in contact. In some embodiments, the receive coil and/or transmit coil comprise means for vibration dampening at the coupling interface therebetween.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which.

DETAILED DESCRIPTION OF THE INVENTION

Figure 1:
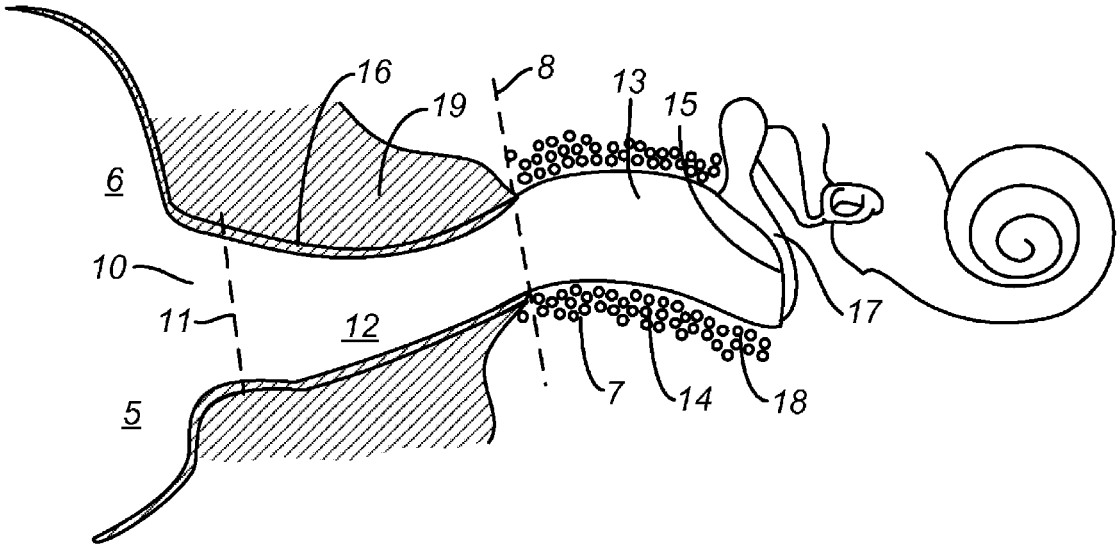
FIG. 1 is a side view of the external ear canal, described above.
Figure 2:
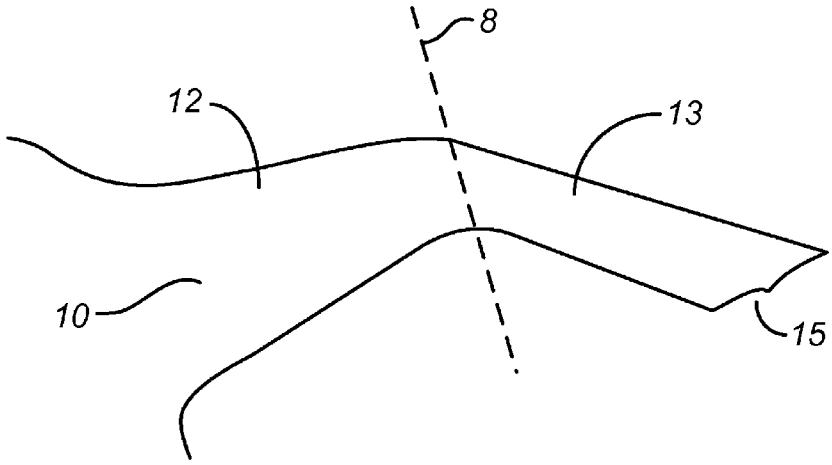
FIG. 2 is a top-down view of the ear canal showing the contours and narrowing in the bony region and the challenge of fitting a canal hearing device therein.

The present invention provides a modular canal hearing device with a speaker module placed semi-permanently for extended wear in the bony region of the ear canal in close proximity to the tympanic membrane (eardrum).

The modular canal hearing device 30 of the invention will be described with reference to FIGS. 3-10. The canal hearing device 30 comprises a speaker module 40 secured inside the ear canal by a retainer 41 in the bony region 13 (FIG. 4). The speaker assembly 42 within emits acoustic signal 48 to the eardrum 15 in proximity. Laterally with respect to the ear canal 10, the canal hearing device 30 further comprises a main module 50 which contains a microphone 56 (FIG. 8), electronic components for processing and amplifying sound (not shown), battery 57 for powering the main module 50. The main module 50 is not electrically connecting to the speaker module 40 but instead employs near-field wireless proximity coupling as will be described below. The battery 57 may be primary or rechargeable type.

In a preferred embodiment, wireless coupling is achieved by a pair of inductive coils as shown FIGS. 3-10, whereby the main module 50 emits electromagnetic signal 58 (FIG. 6) to the speaker module 40 to activate it and to produce audio signal 48 at the eardrum 15. Electromagnetic signals 58 are produced by transmit coil 51 within main module 50 and received by inductive coil 43 integrated within speaker assembly 42. Coupling interface 44 is shaped and designed to ensure self-alignment of coupling elements 51 and 43 when the main module 50 is inserted in the ear canal and in proximity to the speaker module 40.

The semi-permanent placement of the speaker module 40 in the bony region 13 eliminates friction in the bony region which is known to be very sensitive to touch and pressure and can be easily abraded. By placing the speaker module in the bony region once and for an extended period, adaptation and acclimation to its wear by the human body is accelerated. This is in contrast to frequent insertions of conventional CIC devices which cause irritation in the bony region and ultimately pain and lacerations, as well known in the art of completely in the canal (CIC) hearing aids—particularly those with insertions into the bony region, even when employing very soft and compressible material. The skin in the bony region is very thin, vascular, and with nerve endings thus has little tolerance to rubbing or motion contact of any kind. Even when there is no irritation or discomfort during the initial placement of a prior art hearing device, problems often occur later with repeated touch or when device motion is transferred to the bony region. In contrast, the present invention relies on a receiver assembly 42 that mechanically and vibrationally isolated from a device that excludes a receiver assembly.

By excluding major components such as a microphone and battery, the receiver module 40 becomes exceptionally small and highly maneuverable in the ear canal. This further allows for easier visualization and navigation into and out of the ear canal. Similarly, the main module 50, being separate and excluding a receiver assembly, is also smaller and easier to insert and manipulate in the ear canal. The concept of smaller and separate is crucial in understanding the present invention and can also be further understood by the analogy of maneuvering two smaller ladders separately, versus being combined in one long ladder, through a narrow and contoured hallway.

Figure 4:
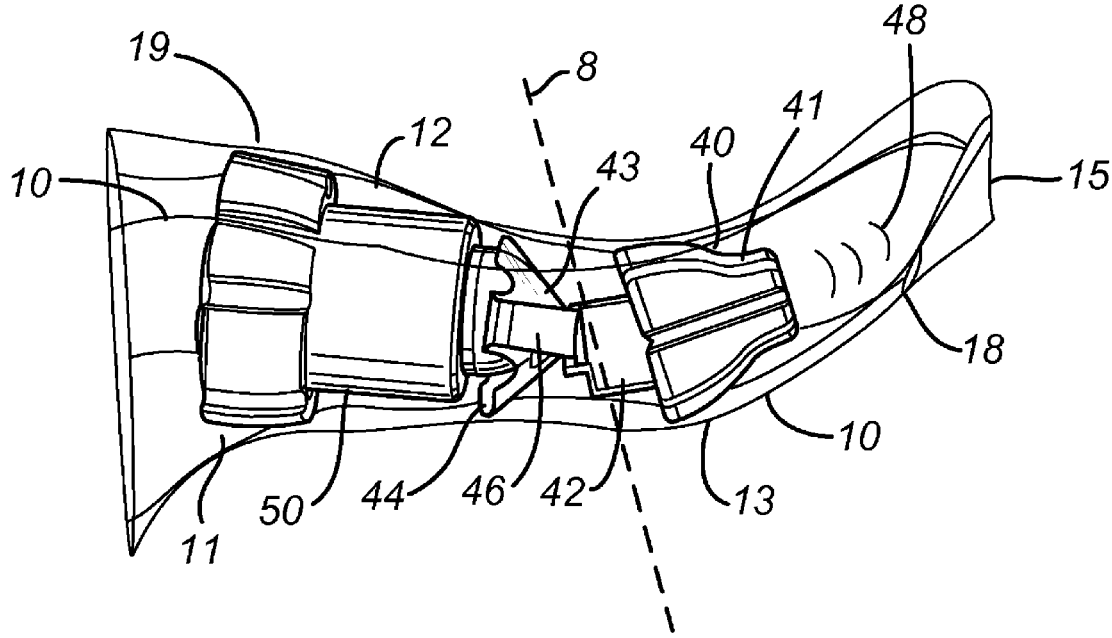
FIG. 4 is a view of the modular device in the ear canal with speaker module activated by the main module in proximity thereto.
Figure 5:
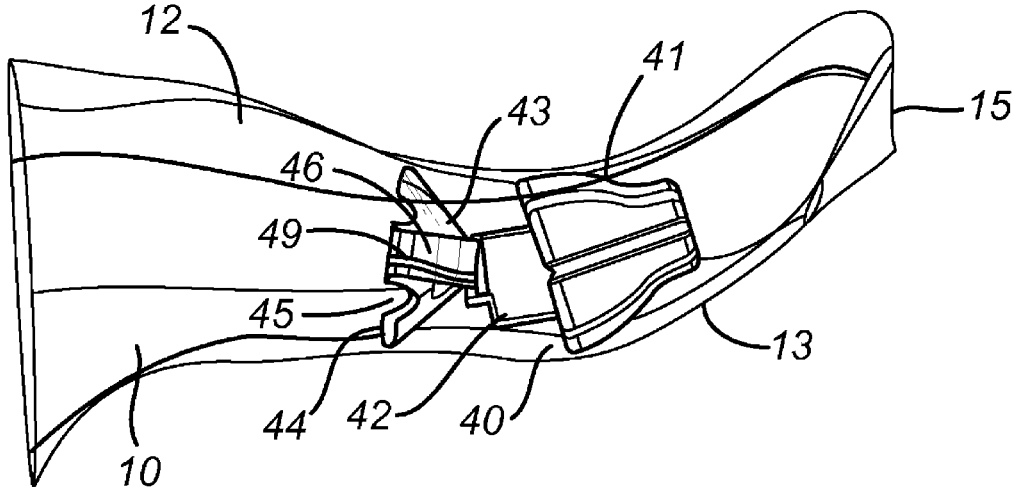
FIG. 5 is a view of the semi-permanent speaker module inserted in the bony region of the ear canal prior to the insertion of the main module.

The speaker module 40 is placed within exceptional proximity to the tympanic membrane 15 (as shown in FIGS. 4 and 5). This ensures sound delivery more efficiently and faithfully to the eardrum, particularly at high frequencies above 4 KHz in the audible range. In the preferred embodiments, the medial (inner) edge of the speaker module is placed within 4-10 mm from the lateral (outer) edge 18 (FIG. 4) of the tympanic membrane 15. In the preferred embodiment, the speaker module 40 remains in the immobile bony region 13 of the ear canal for extended wear exceeding 4 months. This was not conceivable with prior art extended wear for various reasons, disclosed throughout the application, and furthermore by the absence of a power source within the receiver assembly, thus eliminating the need for its removal to replace a battery. The receiver module 40 of the present invention is passive and relies on the main module 50 or a separate device placed in proximity thereto for its activation. Flexible connection (not shown) may also be provided at the main module side, and particularly at the transmit coil 51 area to provide mechanical and vibration isolation between the receiver module 40 and main module 50. Those skilled in the art would readily understand that flexible connections can be provided at either or both sides of the modular design to achieve the desired isolation.

In contrast, the main module 50 is positioned laterally in the cartilaginous region 12, which is more robust, easily accessible, and far less sensitive to touch and motion. The main module 50 and the receiver module 40 are mechanically isolated by an air gap, or by a weak incidental contact when the wireless coupling elements are in separable contact to one another inside the ear canal. Separable incidental contact can be achieved by incorporating a flexible connector 46 to dampen the vibration when the two coils come in contact inside the ear canal. This mechanical isolation is necessary to prevent transmission of vibrations between the receiver module 40 and the main module 50, thus minimizing feedback, which is a major impediment for proper operation of a hearing device, particularly a canal device. The mechanical isolation of the present invention also aids in preventing transfer of motion from the main module onto the receiver module during normal daily activity such as during jaw movement, sleeping on the ear, yawning, etc.

In a preferred embodiment, shown in FIG. 4, the modular 2 piece hearing device 30 is placed substantially in the ear canal with main module 50 placed at or past the aperture 11 of the ear canal. The receiver module 40 is placed in the bony region in the ear canal which avoids contamination of the receiver module from physiologic debris (i.e, cerumen) present mostly in the cartilaginous region of the ear canal. This allows for continuous reliable operational exceeding 4 months. Deep placement of the separate and modular design of the present invention, also allows for invisible and hassle free wear, features highly sought after by hearing impaired individuals typically reluctant to wear a conspicuous hearing device. The placement of a microphone inside the ear canal, or at the aperture area, also provides natural sound pick-up by taking advantage of the acoustics from the pinna and the concha areas. The combination of deep receiver placement near the eardrum and microphone placement within the ear canal results in other electroacoustic advantages including less distortion, less wind noise, less system noise, higher maximum output and improved sound localization, particularly in noisy conditions. Prior art hearing devices with microphones placed outside the ear canal adversely affect the hearing ability and localization of sound.

The receiver module 40 may be inserted by a hearing professional such as an ENT physician, an audiologist or a hearing aid specialist, for providing proper inspection of the ear, cleaning of the ear canal, and safe placement of the receiver module 40 in the bony region within proximity to the eardrum. The receiver module is placed in the ear canal first prior to inserting the main module as shown in FIG. 5. The receiver module 40 may also be self-inserted by the user, preferably after sizing and inspection of the ear canal by a hearing professional during the initial fitting and trial process. It is also conceivable and well within the scope of the present invention for the user to self-insert the receiver module 40 with proper tools and instructions.

The main module 50 is laterally positioned and is designed for insertion and removal by the user on an as-needed-basis, including for daily wear. This is possible since it readily accessible and with less concern for damage to the ear. In the preferred embodiments, modules 50 and 40 are offered in generic sizes and shape to fit a variety of ears without resorting to custom manufacturing, as with most conventional CICs. In the preferred embodiments, the device is remotely controlled for activation and/or adjustment by wireless means known in the art of hearing air remote control. This includes but not limited to the use of radio frequency (RF), magnetic, optical, acoustic and ultrasonic signals.

The present invention facilitates insertion of smaller modules in the ear canal. The main module is considerably shorter and smaller than a prior art CIC since the receiver and its housing are excluded from the main module. The size and length reduction is particularly significant for insertion and manipulation into smaller ear canals and those with severe contours, and for the elderly who typically suffer from poor manual dexterity and would not be able to manipulate a longer larger device deep into the ear canal. For reference purposes, a miniature hearing aid receiver is typically about 6 mm in length and by removing this length from the main module creates a considerable difference in a person's ability to insert in the ear canal. The present invention allows the user to remove the main module as frequently as needed to maintain the device, such as to replace the battery, replace sound filters, clean the device, program it, recharge the battery if rechargeable, etc, all without disturbing the receiver module which remains in the acclimated bony region. The removal of the main module also allows for maintenance of the ear canal for improved drying and healthy air circulation within.

In a preferred embodiment, the speaker module 40 comprises a coupling interface 44 (FIGS. 4 & 7) housing a receiver element 43 shown as coil. The coupling interface 44 is connected to receiver assembly 42 via flexible connector 46 incorporating within electrical wires (49 in FIGS. 5 & 6) for electrically connecting the speaker assembly 42 or its electronics (not shown) to the receiver coupling coil 43. The coupling interface 44 is shown conical in shape for self-centering mating with the transmitting element 51 of the main module 50, also shaped conical for optimally mating thereto. However, the wireless interface and coupling design may be formed of any shape and material to optimize wireless energy coupling between the modules and for mechanical and vibration isolation. For example, by incorporating low-duremeter elastomer, foam padding and like material. The coil interface may also incorporate ferromagnetic material to improve the electromagnetic coupling between the two coils. Notches 45 along the circumference of the coupling interface 44 provide additional flexibility, improved visualization, and improved air venting and aeration in the ear canal.

Figure 3:
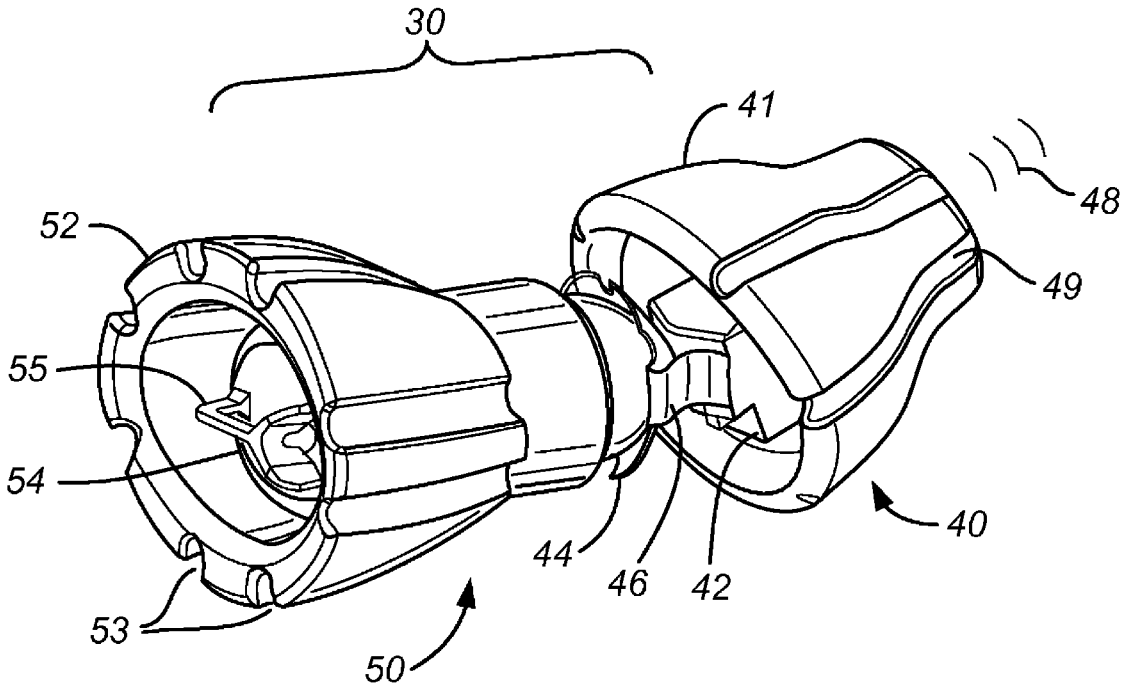
FIG. 3 is a view of the invented device showing the main module mechanically separate and connecting to the speaker module via a wireless proximity coupling.
Figure 9A:
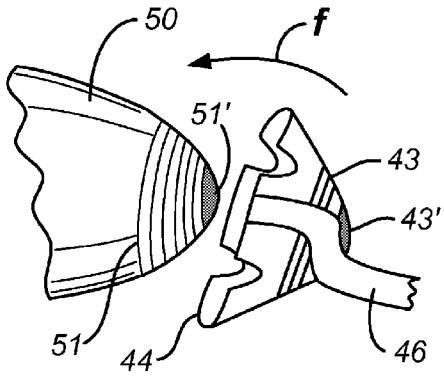
FIGS. 9*a* and 9*b* showing the process of bonding coupling coils with magnetic attraction incorporated within coupling interface.
Figure 9B:
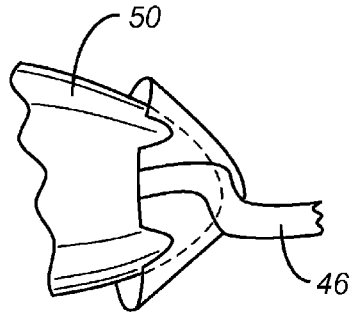
Figure 10:
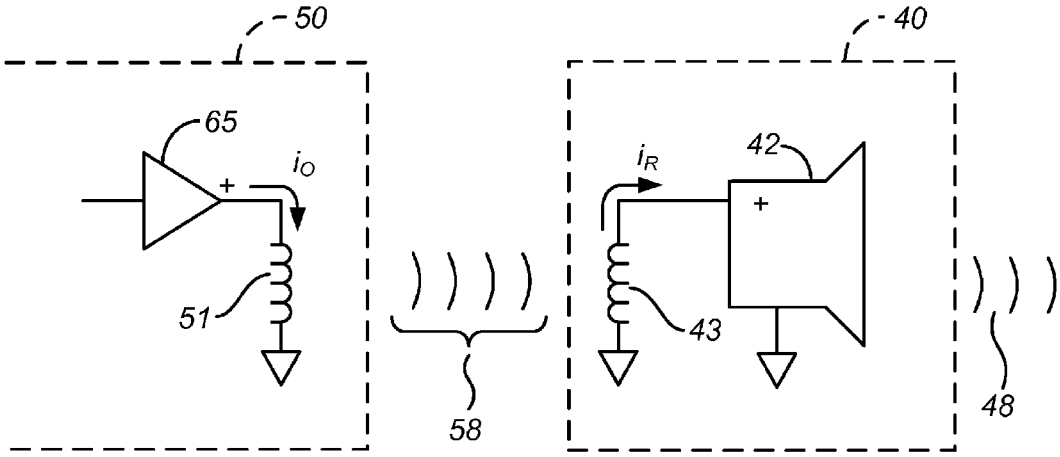
FIG. 10 shows schematics of direct electromagnetic inductive coupling of audio signals with transmit and receive coils.

The wireless coupling of the present invention occurs within near-field proximity for efficient energy transfer and for proper activation of the speaker module as shown in FIGS. 3 & 4. In the preferred embodiments, the coupling elements, shown as coils in the figures, are less than 5 mm form each other and the elements are insulated such that coupling coils are not electrically exposed or connecting to one another. Incidental mechanical contact of the coupling elements is allowed and in some cases may be preferable to ensure continued proximity of the coupling elements and uninterrupted operation. This can be achieved by providing weak attraction and bonding between the coupling elements that maintain a breakable bond once the coils are within operable range. For example, by incorporating a magnet on one side and ferromagnetic material within the other side of coupling interface for the coupling elements to attract and maintain flexible contact. The weak flexible bond is readily breakable when the main module 50 is pulled out of the ear canal 10 leaving the speaker module 40 securely attached within the bony region for extended wear therein. FIGS. 9*a-b* show an embodiment of magnetic attraction between coupling elements using magnet 51' incorporated in the medial tip of the main module 50 causing attraction force f and bonding to magnetic material 43' incorporated at the center of coupling interface 44 of receiver module 40. This attraction leads to maintained bond between coupling elements 51 and 43 as shown in FIG. 9*b*. The flexible connector 46 and weak attraction maintains operational proximity of the coupling elements during in-situ movements of the main module 50 with respect to the speaker module 40. However, the bond is broken readily upon removal of the main module from the ear canal, without pulling or dislodging the speaker assembly which remains in the bony region 13 for extended wear therein.

Although inductive coupling employing coils is shown as a preferred embodiment on the present invention, other wireless proximity coupling including, capacitive, electrical field, ultrasonic and other methods are possible and within the scope of the invention which provides electromechanical isolation through near-field energy coupling, defined herein as within 5 mm, which is approximately the short diameter of an ear canal in the bony region.

The receiver module 40 remains in the ear canal for continuous extended wear of at least 1 month and preferably more than 4 months. In contrast, the main module is worn typically for short term wear and may be removed daily, weekly or up to 1 month if remains comfortable to wear in the ear canal for that long. The main module 50 is preferably highly vented for moisture relieve in the ear canal. The speaker module 40 is preferably single-use disposable for replacement every 4-6 months depending on the condition of the individual ear canal. These conditions are known to vary among individuals depending on age, physical activity, water exposure, swimming and bathing habits, shampoo exposure, as well as environmental factors, which vary from one region to another.

The main module 50 is intended for relatively frequent removal for variety of reasons including battery replacement needs, device maintenance, contamination of the main module, temporary malfunction such as when a sound port is soiled, as well as for general relieve and maintenance of the ear canal after a daily wear as commonly recommended for users of CIC and ITC users. The main module in the preferred embodiment incorporates the disposable elements such as battery, replaceable cap (55), replaceable debris filter, sound permeable membrane filter, any of which are to be replaced when depleted or damaged. Physiologic debris in the ear canal, such as earwax, is known for its invasive and corrosive effects in hearing aid design. Earwax is particularly damaging to microphone sound ports, which require air access for optimal performance. Earwax can also migrate to the diaphragms within the transducers causing degradation of performance. By providing replaceable filters for the main module, protection of sensitive components is provided. The disposable elements of the main module maybe combined in a unitary assembly for easy replacement. For the speaker module 40, earwax and moisture contamination is minimized by (1) placing the receiver assembly 42 deep in bony region, which is relatively free from physiologic debris, and (2) eliminating frequent insertions which is known to cumulatively scope earwax into receiver sound port.

Figure 6:
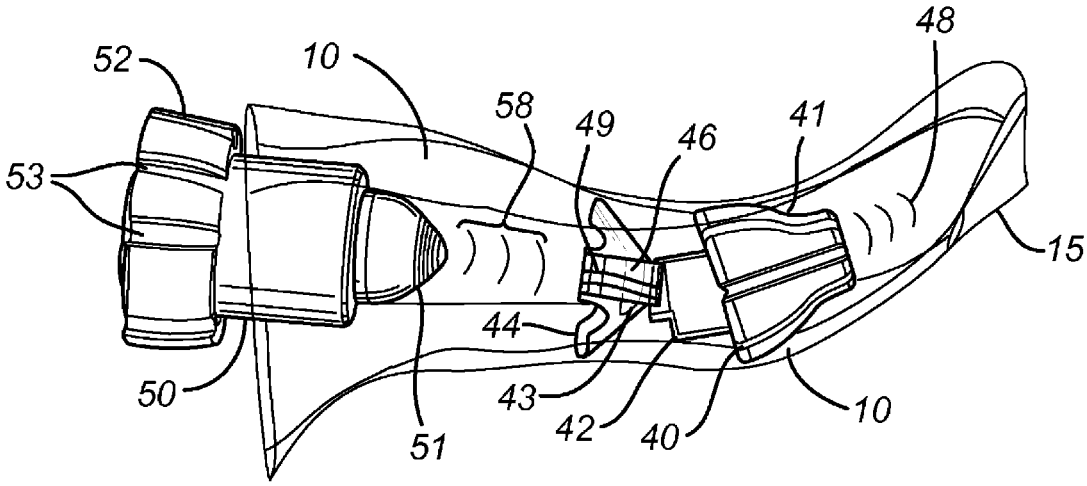
FIG. 6 shows the insertion of the main module into the ear canal prior to its final position, with receiver module already inserted and inactive.

FIGS. 5, 6 and 4 show the insertion process of the modular design in typical hearing aid applications. The speaker module 40 is first inserted in the bony region of the ear canal as shown in FIG. 5. Proper visualization and positioning is relatively easy with the speaker module 40 inserted alone since major landmarks within the ear canal, i.e., the second bend, remain visible without the presence of other components normally blocking the viewing. The speaker module is shown inserted just past the bony-cartilaginous junction at the second bend 8. It should be understood that placing the speaker module 40 past the second bend 8 ensures long term stability and retention within the ear canal, even when considering lateral migration of the epithelium. Briefly described here; the epithelia (skin) tissue in the ear canal grows and moves in a lateral (outer) direction resulting in outward extrusion of debris and foreign material towards the outside of the ear. One can think of this as nature's way for self-cleaning the ear canal. The epithelium migration phenomena would also push the speaker module outward if not properly secured within. However, placement of a speaker module past a natural bend, such as the second bend, provides retention force to counter that of lateral migration as described above.

FIG. 6 shows main module 50 being inserted into the ear canal toward its final operational position shown in FIG. 4. The placement process of the main module 50 may be assisted electronically by proximity sensing methods. For example, by sensing the mutual inductance of the coupling coils and providing beeping sound to the user during insertion, and to indicate proper proximity between the main module 50 and the speaker module 40. Inductive coupling between the coupling elements is particularly suitable for distance sensing, since it allows sensing of mutual inductance and inductive loading effects which can indicate proximity to the receiver module 40 during insertion of the main module.

Electronic circuitry (not shown) in the main module 50 typically comprise analog and digital components including digital signal processor for sound processing. This is typically in the form of integrated circuit combined with discrete components on a circuit board that may be rigid or flexible. A flexible circuit assembly is preferred for incorporating and connecting miniature electronic and transducers including microphone and switches. Unlike conventional hearing devices, the speaker module 40 is not electromechanically connected to the main module 50. Certain electronic components may also be incorporated in the receiver module 40 for decoding and post processing of wirelessly coupled signal. Electronic and transducer components within the main module 50 and the receiver module 40 are preferably insulated and coated for preventing damage due to moisture presence in the ear canal as well as against periodic water exposure during bathing or swimming.

The receiver assembly 42 is placed within exceptional proximity to the tympanic membrane 15 thus reducing receiver output requirements and energy consumption of the hearing device. This also reduces the vibration levels for improved sound quality and control of feedback. To further reduce feedback, a sealing retainer 41 is concentrically positioned over the receiver assembly 42 to attenuate sounds reaching the microphone 56 of the main module 50. Venting channels 49 are uniquely provided on the outer surface of speaker retainer 41 for pressure venting and aeration across the retainer 41. Venting channels 49 are relatively small in diameter since moisture presence is minimal in the bony region of the ear canal. In the preferred embodiment, the retainer 41 provides at least 20 decibels of acoustic attenuation between the speaker assembly 42 and the microphone 56 at audiometric frequencies between 500 and 4000 Hz.

Main module retainer 52 provides additional acoustic attenuation with relatively larger vent channels 53 across its longitudinal direction to relieve the ear canal form moisture present at greater extent within the cartilaginous region. Vents channels 53 also aid in relieving the occlusion effect by channeling a person's own-voice outward towards the outside of the ear canal. This relative venting system of large channels 53 and small channels 49 provide a unique system of moisture and occlusion-effect relieve in the ear canal.

Figure 7:
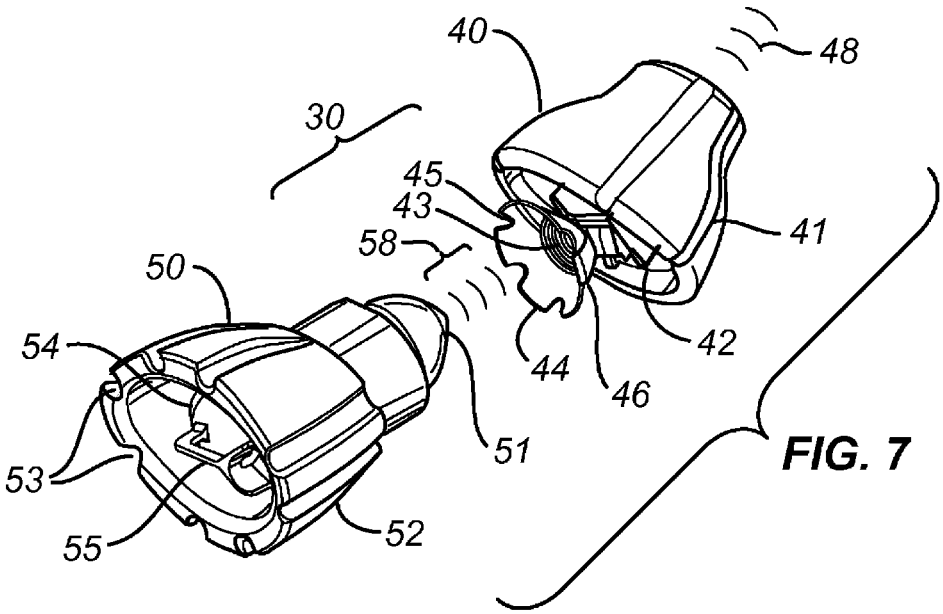
FIG. 7 shows a more detailed view of the invented device with main module and wireless coupling signal for powering and activation of the speaker module.
Figure 8:
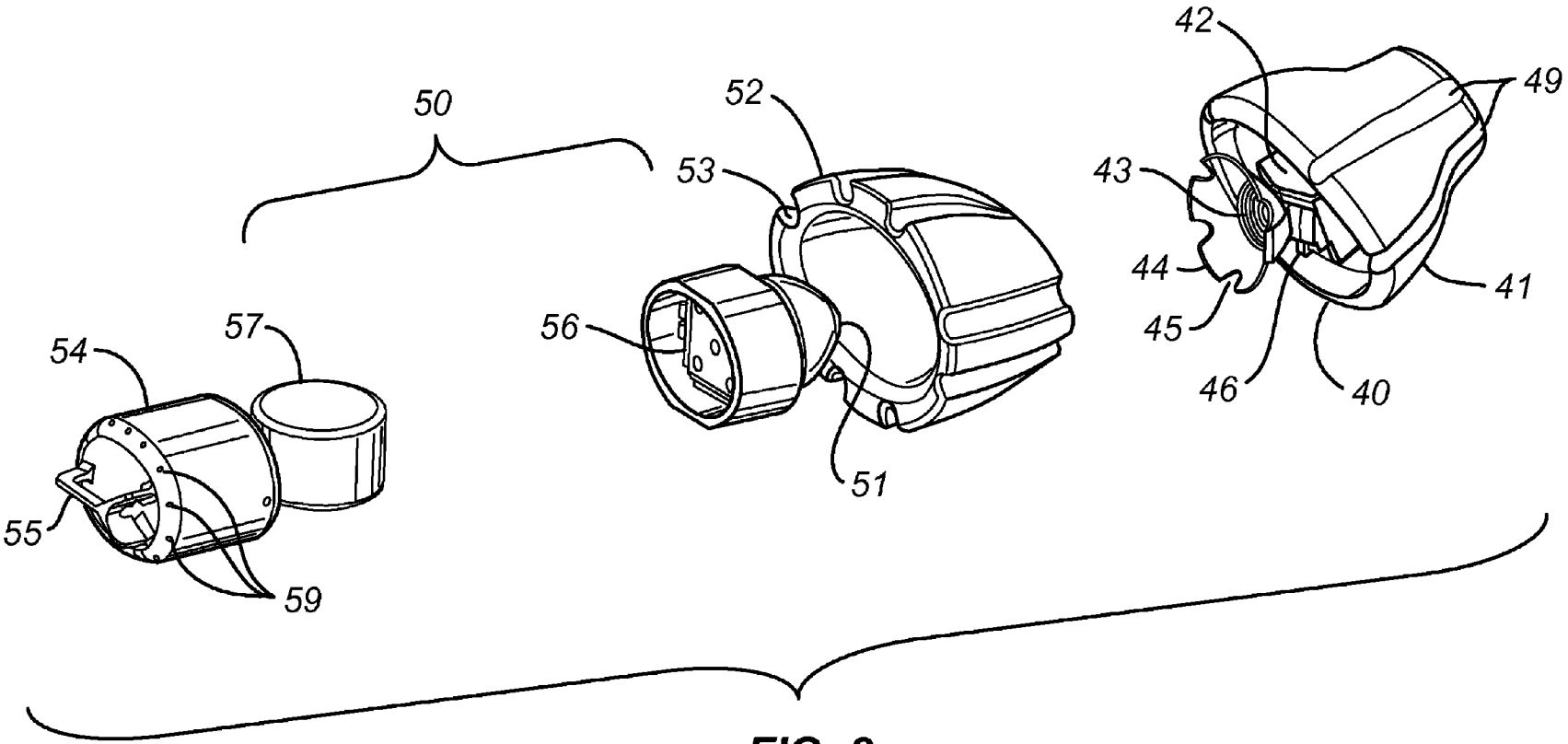
FIG. 8 shows an exploded view of the main module exposing key parts within such as battery, microphone and lateral cap.

In the embodiments shown, venting channels 49 and 53 are provided as part of the outer structure thus eliminating the need for providing interior venting (i.e, tubing) typically employed in prior art hearing aid design. Retainers 52 and 41 are made of soft compressible or compliant biocompatible material such as medical grade polyurethane or silicone and preferably incorporate anti-microbial or anti-bacterial agents to prevent contamination of the ear canal and the device during extended wear in the ear canal. The lateral retainer 52 may be made more or less resilient and washable since it placed in the accessible region of the ear. Main module cap 54 covers the battery 57 and maybe made replaceable and disposable along with the battery 57 and other protective elements such as sound filter membrane (not shown) incorporated within. Air holes 59 (FIG. 8) are incorporated in the cap 54 to allow sound and air access to the microphone 56 and battery 57 within the main module 50. The cap incorporates removal features such as a removal strand (not shown), loops (not shown) or grip handle 55 as shown in FIG. 7 for use by finger tips or removal tool (not shown). Access to the main module 50 is relatively easy due to the lateral placement in the ear canal and the application of methods and tools known in the art of canal hearing devices. In a preferred embodiment, the cap 54, handle 55 and battery 57 are incorporated in a unitary disposable module that can be separated and replaced periodically.

The wireless coupling signal 58 may represent audio signal directly in the audio frequency range or coded in an appropriate scheme known in the art of communications such as frequency modulation (FM), amplitude modulation (AM), pulse code modulation (PCM), frequency shift keying (FSK), etc. The coupling signal 58 is detected and decoded by coupling interface circuitry (not shown) incorporated within receiver module 40 for producing audible signal 48 to the tympanic membrane. Proximity power links and data links are well known in the art of medical implants and wireless charging and can be applied herein for the modular wireless design of the present invention. For example, see Selective Signal Transmission to Inlaid Microcoils by Inductive Coupling, Jie Wu and Gary Bernstein IEEE, Transducers 2003, $12^{th}$ International Conference of Solid State Sensors transducers, Boston 2003.

The receiver module 40 of the present invention is passive—meaning herein that it does not require an internal power source—thus reducing its size considerably. This is achieved by relying on the main module 50 to send audio data wirelessly to the receiver module 40 and for the power required to activate the vibrating elements within the receiver. This however should not preclude incorporating passive energy storage elements such as a charge capacitor (not shown) which may be incorporated in the receiver assembly 42 for receiving and temporarily storing energy wirelessly transmitted by the main module 50. This and other interim power and audio transfer concepts should not be viewed as departing from the goal and spirit of the present invention with power being primarily supplied from the main module 50 to activate and operate the receiver assembly 42 wirelessly. In a simple embodiment of wireless proximity transmission, shown in FIG. 10, the audio signal is provided by audio amplifier 65 which produces output current $i_o$ through output coil 51 and this in turn produces wireless electromagnetic coupling signal 58 in the audio band for near-field wireless reception by receive coil 43 which produces a mirror image current $i_R$ which flows into the receiver 42 producing audible acoustic signal 48 at the tympanic membrane. In this embodiment, audio and power signals are in the same form and no decoding of audio signal is required. Other schemes are known to be more energy efficient, mainly by transmission in selected frequencies and with the application of tuned coil circuitry. These energy efficient designs are well known in the field of telemetry and wireless transmission and require additional circuitry for decoding and demodulating.

The present invention with its unique design aspects and attributes, leads to a unique form factor hearing device combining daily wear and extended wear components. The modular design offers smaller modules that are easier to fit and maneuver in more types of ear canals including small, narrow and contoured ones. Furthermore, by removing internal power requirements, the extended wear receiver module 40 can operate therein continuously for extended periods exceeding 4 months.

The hearing device of the present invention is preferably water-resistance to withstand moisture and water exposure while in the ear canal. However, should the main module becomes too wet, damaged, plugged by earwax, or power depleted, it can be removed and its cap 54, battery 57 or the retainer 52 may be washed, cleaned, or replaced without disturbing the speaker module 40 which remains in the bony region for extended periods throughout repeated main module removals.

It should be understood by those skilled in the art that coupling energy wirelessly to a passive device across a short distance is different from remote wireless transmission, which requires power sources on both sides of the communication channel. In the present invention, the receiver module 40 is passive in terms of power requirement and remains in the ear canal semi-permanently since it has no internal power source. Since receivers are designed to function reliably for several years prior to their breakdown and the bony region is relatively physiologically inactive, it is conceivable to place the receiver module in the bony region for periods well exceeding 4 months, such as 6 or 12 months, provided that adequate venting and biocompatibility design principles are considered and undertaken.

Other embodiment of this invention includes placing a main module partially outside the ear canal such as in the concha region 5 or behind the ear for improved access for person of limited dexterity. In these embodiments, all that is required is a coupling coil placed inside the ear canal in proximity to the receiver module held in the bony region as shown in FIG. 5.

Although a presently contemplated best mode of practicing the invention has been described herein, it will be recognized by those skilled in the art to which the invention pertains from a consideration of the foregoing description of presently preferred and alternate embodiments and methods of fabrication and use thereof, that variations and modifications of this exemplary embodiment and method may be made without departing from the true spirit and scope of the invention. Thus, the above-described embodiment of the invention should not be viewed as exhaustive or as limiting the invention to the precise configurations or techniques disclosed. Rather, it is intended that the invention shall be limited only by the appended claims and the rules and principles of applicable law.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A modular hearing device for inconspicuous wear in the ear canal, comprising:

a speaker module for placement medially in the ear canal in the bony region and in proximity to the eardrum, said speaker module comprises a speaker assembly for delivering amplified sound to the tympanic membrane, a skin contacting retainer for retaining said receiver assembly entirely in said ear canal, and a receive coil for wireless reception of electromagnetic signal representing audio signals; and a main module laterally positioned primarily in the cartilaginous region of the ear canal, comprising a microphone, a power source and a transmit coil for wireless transmission of said electromagnetic signal representing audio signal to said receive coil within said speaker module, said main module is separately removable from the ear canal while said speaker module remains therein when said main module is removed; and wherein said speaker module is activatable by the presence of said main module when placed inside the ear canal in proximity thereto.

2. The hearing device of claim 1, wherein said retainer provides acoustic attenuation between said speaker assembly output and microphone input within the audiometric frequency range between 500 and 4000 Hz.

3. The hearing device of claim 1, wherein said power source is a primary battery or a rechargeable battery.

4. The hearing device of claim 1, wherein any of said receive coil and transmit coil comprise a flexible connection for providing vibration and motion isolation between said speaker module and said main module when said receive and transmit coils are in contact.

5. The hearing device of claim 1, wherein any of said receive coil and transmit coil comprise means for vibration dampening at the coupling interface therebetween.

6. The hearing device of claim 1, wherein said transmit coil is placed less than 5 mm from said receive coil for the hearing device to be operable.

7. The hearing device of claim 1 further comprising magnetic material for maintaining a weak breakable bond between said receive coil and transmit coil.

8. The hearing device of claim 1, wherein said hearing device is programmable and adjustable.

9. The hearing device of claim 1, wherein said retainer comprises a compliant polyurethane foam material.

10. The hearing device of claim 1, wherein said retainer comprises a medical grade silicone material.

11. The hearing device of claim 1, wherein said retainer comprises an anti-microbial agent and/or anti-bacterial agent to prevent contamination during an extended wear of said hearing device in the ear canal.

12. The hearing device of claim 1, wherein said main module further comprises a disposable element to be discarded and replaced when said disposable element is depleted, damaged or contaminated.

13. The hearing device of claim 1, wherein said electromagnetic signal directly represents audio signals.

14. The hearing device of claim 1, wherein said receiver module further comprises a decoder circuit for receiving coded electromagnetic signals and decoding it for producing signal in the audio frequency range.

15. A modular hearing device for inconspicuous wear in the ear canal comprising:

a passive speaker module for placement medially in the bony region of the ear canal, said speaker module comprises a speaker assembly for delivering sound to the tympanic membrane, a skin contacting retainer for retaining said speaker module within the ear canal in said bony region, and a wireless sensor element for receiving wireless signals representing audio signals; and a main module laterally positioned within said ear canal substantially in the cartilaginous region thereof, said main module comprises a microphone, a power source, and a wireless transmitter element for sending wireless signal to said speaker module, said main module is removable from the ear canal separately from said receiver module; and wherein said passive speaker module is powered and activated by the presence of said main module when said main module is placed inside the ear canal in proximity thereto.

16. The modular hearing device of claim 15, wherein said speaker module remains in the canal said for extended wear exceeding one month.

17. The modular hearing device of claim 15, wherein said wireless sensor element and wireless transmitter element comprise inductive coils for coupling electromagnetic signal therebetween.

18. A modular hearing device for inconspicuous placement in the ear canal, comprising:

a speaker module semi-permanently placed in the bony region of the ear canal, said speaker module comprises a speaker assembly for delivering sound to the tympanic membrane, a retainer for retaining said speaker assembly in the ear canal in said bony region, and a receive coil for wirelessly receiving signals from a transmitter coil placed in the ear canal in proximity to said receive coil; and a transmitter coil positioned laterally in the ear canal within less than 5 mm from said receive coil, said transmitter coil is separately and independently removable from the ear canal with respect to said speaker module;

wherein said speaker module is passive and activated by the presence of said transmitter coil when said transmitter coil is introduced in the ear canal in proximity to said receiver module.

19. A method of hearing with a modular canal device comprising the steps of:

placing a speaker module in the bony region of the ear canal, said speaker module comprises a speaker assembly and a receive coil;

placing a main module in the cartilaginous region of the ear canal, said main module comprises a microphone, a battery sources and a transmitting coil; and activating said speaker module by the presence of said main module within less than 5 mm of said speaker module.

20. The method of hearing in claim 19, wherein said speaker module remains in the ear canal for at least one month while the main module is separately removable from the ear canal in less than one month.

21. The method of claim 20, wherein said extended wear of said speaker module exceeds 4 months.

22. The method of claim 19, wherein said main module is worn as a daily wear device.

23. The method of claim 19, wherein said speaker module is placed in the ear canal past the second bend for secure retention therein.

24. A method of hearing with a modular canal device comprising the steps of:

placing a speaker module in the bony region of the ear canal, said speaker module comprises a speaker assembly and a receive coil;

placing a removable module in the cartilaginous region of the ear canal, said removable module comprises a transmitting coil; and activating said speaker module by the presence of said removable module within less than 5 mm of said speaker module.

* * * * *